United States Patent [19]

Ferri et al.

[11] 4,281,937

[45] Aug. 4, 1981

[54] MIXER

[75] Inventors: Joseph E. Ferri, Shillington; Allan A. Gundersen, Sinking Spring; Oliver N. Seelig, Reading, all of Pa.

[73] Assignee: SKG Industries, Inc., West Lawn, Pa.

[21] Appl. No.: 44,458

[22] Filed: Jun. 1, 1979

[51] Int. Cl.[3] ..... B01F 7/00

[52] U.S. Cl. ..... 366/303; 366/304

[58] Field of Search ..... 366/303, 304, 101, 144, 366/145, 147, 149, 155, 244, 245, 246, 279, 292, 293, 341

[56] References Cited

U.S. PATENT DOCUMENTS

| | | | |
|---|---|---|---|
| 2,584,805 | 2/1952 | Leftwich | 366/303 |
| 2,687,877 | 8/1954 | Jensen | 366/303 |
| 3,081,069 | 3/1963 | Oakes | 366/304 |
| 3,251,577 | 5/1966 | Bolanowski | 366/304 |

*Primary Examiner*—Edward J. McCarthy

*Attorney, Agent, or Firm*—Alexis Barron

[57] ABSTRACT

A mixer especially useful for making mechanical foams is disclosed. The mixer includes a stator and a rotor mounted for rotation with respect to the stator, the stator and rotor defining a fluid flow path between them. The fluid flow path includes two shearing zones spaced axially along the rotor. A surface of the rotor extending from the first shearing zone to the second shearing zone defines one boundary of the fluid flow path. The cross-sectional area of the flow path through the mixer is kept substantially constant, varying by no more than about 25 percent, so that zones of stalled flow and low pressure are avoided, thereby maintaining the velocity of the mixture in the flow path relatively high at all times and maintaining a substantial back pressure on the mixture. Portions of the stator and rotor are easily assemblable or disassemblable so that the mixer can be readily converted from a multi-head form to a single-head form.

19 Claims, 3 Drawing Figures

MIXER

FIELD OF THE INVENTION

This invention relates to apparatus for mixing two or more fluids, at least one of which is in a liquid state and another of which is in a gaseous state. More particularly, the invention relates to mixers for making foams.

BACKGROUND OF THE INVENTION

Foamed products have been made on an industrial scale for many years, one such common product being "sponge" rubbers that are made from latices of natural or synthetic rubber. At the outset, these products were formed by beating air into the uncured material and thereafter curing the material while in a foamed state. This beating or whipping process is done in a relatively slow batch-type process rather than a continuous basis and it does not yield good control over cell size, as the bubbles of air whipped into the material by this process tend to be relatively large.

In order to carry out foaming on a continuous basis, other systems have been proposed. One of these is a chemical approach in which a material capable of liberating a gas under certain predetermined conditions, known commonly as a "blowing agent," is introduced into the uncured material. Such systems involve additional cost because of the necessity for the blowing agent; in some instances, the blowing agent or its catalyst leaves undesirable residual materials in the foam, and chemically blown foams tend to have nonuniform cellularization across the cross section of the foam that results from unevenly mixed blowing agent. This latter characteristic is especially evident when the foams are metered onto a substrate and allowed to expand to their free rise density.

Another approach that has been used with substantial success involves the use of a rotary mixer that employs a rotor traveling at high speed. A liquid and gas are introduced, either separately or together, into a housing within which the rotor spins. The liquid/gas mixture flows through a shearing zone that is formed between cooperating surfaces on the rotor and the housing. In the shearing zone, the gas is subdivided into small bubbles to form a froth or foam. Some mixer designs employ a single rotor surface cooperating with a single stator surface to effect shearing, while other designs employ a double-sided rotor that cooperates with two opposed stator surfaces. However, it has not always been possible to achieve desired low densities at high production rates and to produce products having a fine cell structure with such equipment. Also, it has been found that some materials cannot be successfully foamed by such equipment.

Attempts have been made to overcome the shortcomings of single-head mixers by connecting at least two single-headed machines together, with the outlet of the first mixer supplying the inlet of a second mixer. However, even with such arrangements, desired low densities, fine cell size, and the ability to process certain difficult materials have not been forthcoming.

SUMMARY OF THE INVENTION

It is an object of the invention to provide mixers for producing low density foams at commercially viable production rates and with a fine cell structure.

It is a further object of the invention to provide a mixing apparatus that will foam substances that heretofore have been difficult to process.

It is also an object of the invention to provide a versatile mixer construction that can readily be set up in multi-headed or single-headed modes.

These objects are accomplished by a mixer that includes a rotor having at least two longitudinally spaced heads, each of which defines a shearing zone with adjacent portions of the mixer housing. An intermediate surface of the rotor extends from the first shearing zone to a subsequent shearing zone and forms one boundary of a fluid flow path connecting the first shearing zone with the next adjacent downstream shearing zone. The cross-sectional area of the flow path defined between the rotor and stator is maintained substantially constant and not varied more than about 25 percent so that substantial back pressure is maintained on the liquid/gas mixture as it flows through the mixer and the velocity of the mixture through the mixer increases as the mixture passes through the mixer. The mixer housing may be fabricated of a plurality of mating sections, at least one of which can be removed. One of the rotor heads also may be readily removable from the drive shaft. Such an arrangement allows the assembly of a mixer with a desired number of shearing components.

DESCRIPTION OF THE PREFERRED EMBODIMENT

Figure 1:
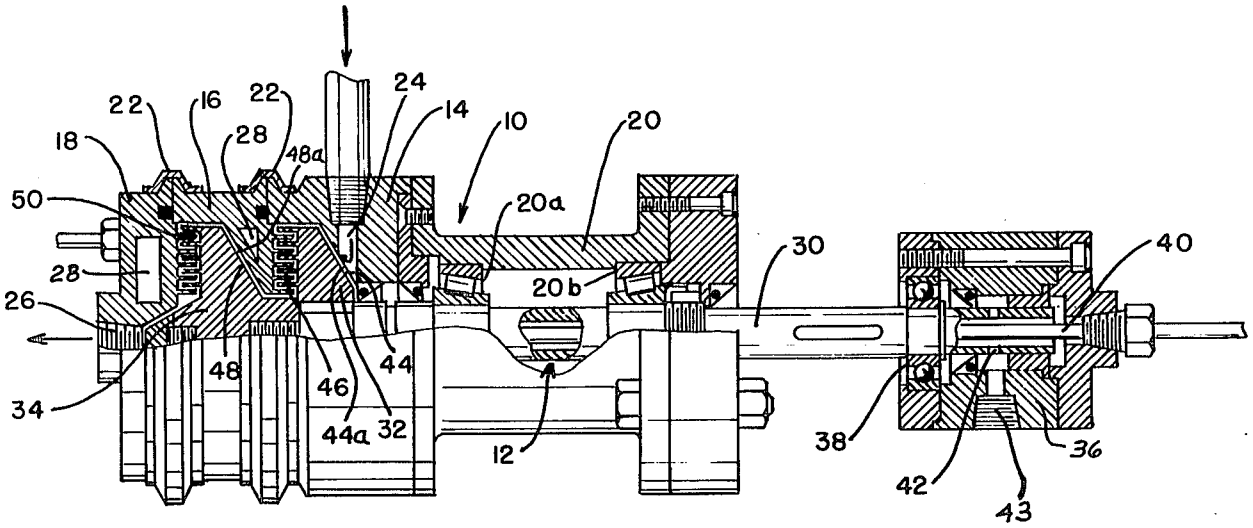
FIG. 1 is a side elevational view, partly in section, of a preferred form of mixing apparatus in accordance with the invention.

FIG. 1 illustrates a preferred design of mixer in accordance with the invention. The mixer includes a stator or housing 10 within which there is rotatably supported a rotor 12. The stator includes a base section 14, a mid section 16 and an end section 18 that are secured together in a readily demountable manner, for example, by a plurality of circumferential flange clamps 22. Suitable pilot surfaces are provided for aligning each of the sections one with the other and the sections can also include suitable sealing members, for example "0" rings, at the interfaces between the members to provide a fluid seal. Each of the sections 16 and 18 incorporates means for cooperating with the rotor to form a shearing zone through which the material being processed passes, as will hereafter be explained.

Affixed to the base section 18, by conventional means such as bolting, is a bearing housing 20 that includes suitable bearings, for example, tapered roller bearings **20*a* and 20*b*. The bearings 20*a* and 20*b* support the rotor 12 for high speed rotation with respect to the stator 10**.

The stator housing 10 also includes a fluid inlet port 24 that is disposed in the base section and that is in fluid communication with a flow path formed between portions of the stator and portions of the rotor. In the embodiment shown, the inlet 24 is generally radially arranged so that the mixture of liquid and gas that is being processed by the mixer is introduced radially inwardly toward the axis of rotation of the rotor. It should be noted that with the inlet port 24 positioned as shown, the liquid/gas mixture impinges on the inclined back surface 44 of a first or upstream rotor head 32.

The stator also includes an outlet portion 26 in the end plate 18 from which the foamed or frothed material issues from the mixer, as indicated by the flow arrow.

It is desirable that the stator section include internal passages 28 to provide for the circulation of a heat exchange medium within the body of the stator so that the temperature of the liquid/gas mixture being processed can be controlled. Usually the high speed processing imparts heat to the mixture and it is usually desirable to remove this heat in order to maintain desired foam characteristics such as density, cell size and viscosity. Suitable fluid connections (not shown) are made to the stator housing in order to supply heat transfer medium to the passages 28.

The rotor 12 includes a longitudinally extending hollow drive shaft 30 that is mounted for rotation by the bearings 20*a* and 20*b*. The shaft can be rotated by any suitable drive means (not shown), the preferred means being an electric motor that drives the shaft 30 by means of a belt or gear transmission system. Desirably, the drive speed is variable so that the speed of rotation of the rotor can be controlled; the drive speed being normally in the range of about 100 to 2,500 rpm. The fore portion of the shaft 30 extends through the central region of the stator base section 14.

A first or upstream rotor head 32 is keyed on the fore portion of the shaft and rotates with the shaft. A second or downstream rotor head is also mounted on the shaft 30 in a manner, for example, screw threads, that allows the head to be readily removed from the shaft. Preferably, the second head is utilized to retain the first head on the shaft when the mixer is assembled in the two-head mode.

Preferably, the back surfaces 44 and 48 of the heads 32 and 34 respectively are generally conical; an (imaginary) apex angle of about 120° has been found useful although conical surfaces of other angularities are believed functional.

The hollow shaft 30 is supplied internally with a heat transfer medium so that the rotor heads 32 and 34 and shaft 30 can be maintained at a desired temperature. In the embodiment shown, the heat circulation system includes a fluid-tight housing 36 that includes a bearing 38 for rotatably mounting one end of the shaft 30. A hollow stem or pipe 40 extends within the hollow shaft 30 to the fore portion of the shaft on which the heads 32 and 34 are mounted. The shaft 30 includes apertures 42 for providing fluid communication between the shaft and a port 43. Thus, it is possible to supply a heat transfer medium through the stem 40, the heat transfer medium fountaining out of the open end of the stem 40 at a point near the fore portion of the shaft. The heat transfer medium then travels in the annular space between the stem 40 and the inside diameter of the shaft 30 and can flow out through the openings 42 and through the exit port 43.

In the mixer shown in FIG. 1, the liquid/gas mixture to be foamed is introduced into the primary inlet 24 where the material impinges upon the generally conical rear or back surface 44 of the upstream rotor head 32. However, it should be realized that the gas, as well as other components of a multi-component chemical system, can be introduced into the housing through separate inlet ports. The mixture flows outwardly away from the axis of rotation of the rotor through the flow passage 44*a* that constitutes the clearance between the rear surface 44 of the rotor and the interior surfaces of the stator section 14 and that extends at an acute angle with respect to the axis of rotation. The material then flows through a first shearing zone 46 that is formed between axially projecting teeth formed on the front surface of the rotor 32 and a corresponding other surface of the stator midsection 16. The material flows through this first shearing zone in a direction toward the axis of rotation of the rotor. Once through the first shearing zone, the material then passes along an intermediate flow path 48 that is disposed at an acute angle with respect to the axis of rotation of the rotor and that constitutes the clearance between the smooth, substantially conical back surface 48 of the rotor head 34 and the adjacent interior surfaces of the intermediate section 16. From the passage 48*a*, the material flows through a second shearing zone 50 that is formed in the same manner as the first shearing zone 46, namely, by a plurality of interfitting teeth, one set of which projects axially forward from the front face of the rotor head 34 and the other of which is associated with the end plate 18.

Preferably, the clearance between the rotor and stator is small so that a significant back pressure is maintained on the liquid/gas mixture as it passes through the mixer. For example, the clearance can range from about 1/32 inch (0.8 mm) in mixers having a four-inch rotor to about 3/32 inch (2.4 mm) in mixers having a fourteen-inch rotor. Desirably, the flow cross section at substantially all points in the flow path defined between the stator and rotor does not vary more than about 25 percent and preferably is substantially constant. It is believed that this factor achieves relatively high and constantly increasing fluid flow velocities throughout the fluid flow path and prevents formation of zones of stagnant flow that can promote the coalescence of gas into larger pockets that can "blow" through the mixer, without mixing with the liquid component, to form relatively large bubbles in the finished foam that adversely affect the uniformity and density of the cured product.

Figure 2:
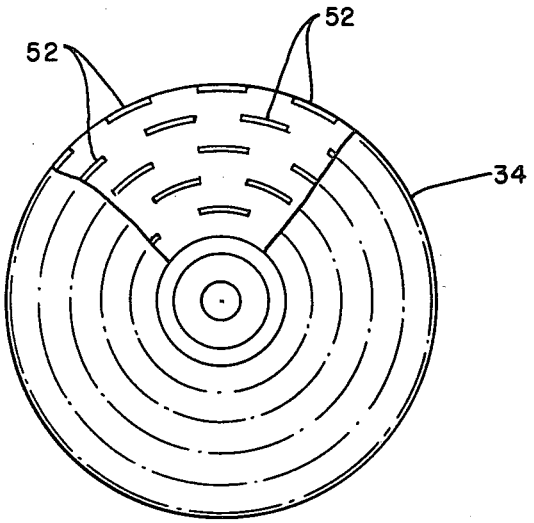
FIG. 2 is a face view of a rotor head, showing a fragment of the shearing surface.
Figure 3:
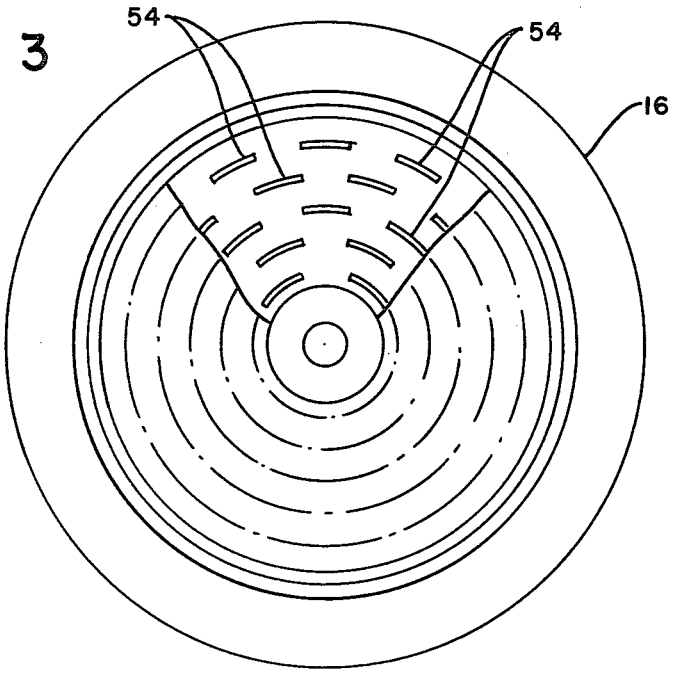
FIG. 3 is a face view of one section of the stator housing, showing a fragment of the shearing surface.

FIGS. 2 and 3 illustrate the shearing means that comprise the shearing zones 46 and 50. For example, the rotor head 34 includes a plurality of axially extending teeth 52 that are arranged in a plurality of concentric circles and that extend forwardly from the front face of the rotor 34, in a direction out of the plane of the drawing. The teeth 52 are arcuate and comprise, substantially, short segments of a circular flange. A similar set of teeth is formed on the front surface of the rotor head 32.

FIG. 3 shows a complementary fixed shearing surface that is formed on the stator sections 16 and 18, in this case, midsection 16. The shearing means includes a plurality of upstanding teeth 54 arranged in concentric circles and extending substantially axially, i.e., parallel to the axis of rotation of the rotor. The rows of teeth 54 on the stator sections are offset from the rows of teeth 52 on the rotor heads so that alternating rows of teeth will interfit, as illustrated in FIG. 1. Such arrangements of teeth to form a shearing zone are generally known in the art and have been used in the past with mixer designs employing a single rotor head. Therefore, no further explication of the details of such an arrangement is believed necessary.

Mixers of the type described have been utilized to achieve densities that are from 15 to 100 percent lower than densities previously achievable with single-head designs. Moreover, the mixer exhibited production rates on the order of 400 to 500 percent higher than single-head machines and produced foams having a much finer cell structure. In addition, one SBR latex compounded in a manner such that it could not be foamed in a single-head machine, produced a commercially acceptable foam when foamed by a mixer made in accordance with the invention.

We claim:

1. A mixing head comprising: a stator, a rotor mounted for rotation with respect to the stator;

the stator and rotor defining therebetween a fluid flow path;

means defining an inlet to the fluid flow path and means defining an outlet from the fluid flow path;

the fluid flow path including a first shearing zone defined between a portion of the rotor and the stator and a second shearing zone, positioned longitudinally and downstream from the first shearing zone and defined between the stator and the rotor;

the fluid flow path including also an intermediate zone extending from the first to the second shearing zone and opening into the second shearing zone, the intermediate zone being defined by the stator and a surface of the rotor extending between the first and second shearing zones, and disposed at an acute angle with respect to the axis of rotation of the rotor.

2. Apparatus as in claim 1 wherein the fluid inlet is positioned to introduce fluid in a direction transverse to the axis of rotation of the rotor and onto a surface of the rotor.

3. Apparatus as in claim 1 wherein the fluid flow path defines a zone upstream of the first shearing zone for providing a fluid flow path extending outwardly of the axis of rotation of the rotor and wherein the intermediate zone provides a fluid flow path extending outwardly of the axis of rotation of the rotor.

4. Apparatus as in claim 1 wherein the cross section of the fluid flow path does not vary more than about 25 percent throughout its length.

5. Apparatus as in claim 1 wherein the flow cross-sectional area of the fluid flow path is substantially constant from the inlet to the outlet.

6. A mixing head comprising:

a stator body;

a rotor mounted for rotation within the stator body;

the stator body including a base section, a mid section and an end section and means for releasably securing the sections together, the mid section being configured to be receivable in mating relationship with the base section and the end section being configured to be received in mating relationship with both the base section and the mid section; and the rotor including a first head and a second head removably positionable adjacent the first head.

7. Apparatus as in claim 6 wherein each rotor head includes a mixing face, the mid section including a mixing surface for operative association with the mixing face of the first rotor head and the end section including a mixing surface for operative association with the mixing surfaces of the first or second heads.

8. A mixing head comprising:

a stator having first and second shearing surfaces;

a shaft mounted for rotation within the stator;

a first rotor head having a shearing surface on one face thereof;

means for mounting the first rotor head on the shaft with the shearing surface thereof in operative association with the first shearing surface of the stator;

a second rotor head positioned downstream from said first rotor head and having a shearing surface on one face thereof;

means for mounting the second rotor head on the shaft with the shearing surface thereof in operative association with the second shearing surface of the stator;

the stator and first and second rotor heads defining therebetween a conical fluid flow path including means through which fluid is capable of flowing from said first rotor head to the shearing surface of said second rotor head; and the stator including means for defining a fluid inlet to the fluid flow path and means for defining a outlet from the fluid flow path.

9. Apparatus as in claim 10 wherein each rotor head has a conical back surface opposite each respective shearing face that cooperates with the stator to form a portion of the fluid flow path.

10. Apparatus as in claim 9 wherein the back surfaces are smooth.

11. Apparatus as in claim 9 wherein the clearance between the surfaces of the rotors and adjacent surfaces of the stator is substantially constant.

12. Apparatus as in claim 9 wherein the apex angle of the surfaces is about 120°.

13. A process for introducing gas into a liquid comprising:

(A) directing a flow of a mixture of liquid and gas from an outer annulus inwardly through a substantially planar shearing zone to a concentric inner annulus;

(B) subjecting said mixture to shearing forces within said shearing zone to effect a foaming of the liquid;

(C) directing the foam thus formed along a frustoconical flow path which communicates at its smaller end with said inner annulus, the axis of said conical flow path being perpendicular to the plane of said shearing zone;

(D) subjecting said foam flowing from said frustoconical flow path to additional shearing forces to effect a further foaming of said liquid.

14. A process according to claim 13 wherein the further foaming of said liquid includes directing the flow of said foam from a second outer annulus inwardly through a second substantially planar shearing zone to a second concentric inner annulus and subjecting said foam to shearing forces within said second shearing zone.

15. A process for introducing gas into a liquid comprising:

(A) directing a flow of a mixture of liquid and gas from an outer annulus inwardly through a substantially planar shearing zone to a concentric inner annulus;

(B) subjecting said mixture to shearing forces within said shearing zone to effect a foaming of the liquid;

(C) directing the flow of the foam thus formed to a second outer annulus and from said second outer annulus inwardly through a second substantially planar shearing zone to a second concentric inner annulus;

(D) and subjecting said foam to additional shearing forces within said second shearing zone to effect a further foaming of said liquid.

16. A process for introducing gas into a liquid comprising:

(A) directing a flow of a mixture of liquid and gas from an outer annulus inwardly through a substantially planar shearing zone to a concentric inner annulus;

(B) subjecting said mixture to shearing forces within said shearing zone to effect a foaming of the liquid;

(C) directing the flow of the foam thus formed to another shearing zone while maintaining on the liquid/gas mixture a back pressure which is effective in maintaining said mixture in its foamed state; and thereafter (D) subjecting said foam to additional shearing forces within said other shearing zone to effect a further foaming of said liquid.

17. A device for introducing gas into a liquid comprising:

(A) first shearing means for foaming said liquid and including a first rotor having periphery and an axis of rotation;

(B) second shearing means for further foaming said liquid and positioned downstream of said first shearing means and including a second rotor having a periphery and an axis of rotation; and (C) means defining a flow path between the periphery of said first rotor and the axis of rotation of said second rotor and extending from the periphery of said first rotor to the axis of rotation of said first rotor, from the axis of rotation of said first rotor to the periphery of said second rotor, and from the periphery of said second rotor to the axis of rotation of said second rotor.

18. A device according to claim 17 wherein the portion of the flow path which extends from the axis of rotation of the first rotor to the periphery of the second rotor is conically shaped.

19. A device for introducing gas into a liquid comprising:

(A) first shearing means for foaming said liquid;

(B) second shearing means for further foaming said liquid and positioned downstream of said first shearing means; wherein each of said first and second shearing means has a common axis of rotation; and (C) means defining a flow path between said first and second shearing means for transfer of said foam from said first to said second shearing means and disposed at an acute angle with respect to said common axis of rotation.

* * * * *